US011346136B2

(12) United States Patent
Gulick, Jr. et al.

(10) Patent No.: US 11,346,136 B2
(45) Date of Patent: May 31, 2022

(54) SECURITY APPARATUS

(71) Applicant: Scorpion Security Products, Inc., Vestal, NY (US)

(72) Inventors: Franklyn W. Gulick, Jr., Vestal, NY (US); Gary R. Page, Chenango Forks, NY (US)

(73) Assignee: SCORPION SECURITY PRODUCTS, INC., Vestal, NY (US)

( * ) Notice: Subject to any disclaimer, the term of this patent is extended or adjusted under 35 U.S.C. 154(b) by 519 days.

(21) Appl. No.: 16/381,474

(22) Filed: Apr. 11, 2019

(65) Prior Publication Data

US 2019/0316386 A1 Oct. 17, 2019

Related U.S. Application Data

(60) Provisional application No. 62/655,911, filed on Apr. 11, 2018.

(51) Int. Cl.
*E05B 73/00* (2006.01)

(52) U.S. Cl.
CPC ..... *E05B 73/0082* (2013.01)

(58) Field of Classification Search
CPC ..... E05B 73/0082; F16M 11/041
USPC ..... 70/58; 248/316.4, 176.1, 451; 361/679.57, 679.58; 379/454, 455
See application file for complete search history.

(56) References Cited

U.S. PATENT DOCUMENTS 1,102,859 A 7/1914 Blackwell
5,457,745 A * 10/1995 Wang ..... B60R 11/0241 379/426
7,111,764 B2 * 9/2006 Smith ..... B60R 9/0485 182/127
8,066,241 B2 11/2011 Yu et al.
8,099,138 B2 * 1/2012 Piekarz ..... B60R 11/0241 455/569.2
8,235,334 B1 8/2012 Kobal
(Continued)

FOREIGN PATENT DOCUMENTS

CN 206973217 U 2/2018
KR 101326687 B1 11/2013
WO 2017/184517 A1 10/2017

OTHER PUBLICATIONS

International Searching Authority, ISR/WO from International Application No. PCT/US19/30559, dated Jun. 14, 2019 and mailed Jul. 12, 2019 (11 pages).

(Continued)

*Primary Examiner* — Lloyd A Gall
(74) *Attorney, Agent, or Firm* — Barclay Damon LLC

(57) ABSTRACT

A security apparatus for retaining a electronic device when being displayed to a customer for evaluation. The security apparatus comprises a housing including a base and a plurality of arms mounting to the base for holding the electronic device. The security apparatus also includes a locking mechanism moveable between a locked position and an unlocked position. The locking mechanism is configured to engage each of the plurality of arms to (i) secure the electronic device in the locked position, and (ii) release the electronic device in the unlocked position. The locking mechanism is accessible to a side of the housing which is inaccessible to the customer.

20 Claims, 11 Drawing Sheets

(56) References Cited

U.S. PATENT DOCUMENTS 8,464,563 B2 * 6/2013 Perez ..... E05B 73/0023 70/57.1
8,833,716 B2 * 9/2014 Funk ..... F16M 13/022 248/316.4
8,864,089 B2 10/2014 Hung
8,985,544 B1 * 3/2015 Gulick, Jr. ..... A47F 7/024 248/551
9,039,785 B2 * 5/2015 Gulick, Jr. ..... G08B 13/1445 726/35
10,165,873 B2 * 1/2019 Gulick, Jr ..... E05B 73/00
10,378,248 B1 * 8/2019 Kelsch ..... E05B 73/0017
10,448,759 B1 * 10/2019 Chapuis ..... A47F 5/16
10,925,414 B2 * 2/2021 Gulick, Jr ..... F16M 11/041
2005/0236536 A1 * 10/2005 Fan ..... B60R 11/02 248/176.3
2007/0043371 A1 2/2007 Teague et al.
2007/0262223 A1 * 11/2007 Wang ..... F16M 13/00 248/346.07
2010/0079285 A1 * 4/2010 Fawcett ..... G08B 13/149 340/568.1
2013/0270850 A1 10/2013 Fan
2013/0301216 A1 * 11/2013 Trinh ..... A47F 7/0246 361/679.58
2014/0263931 A1 * 9/2014 Chen ..... F16M 13/00 248/576
2014/0328020 A1 * 11/2014 Galant ..... G06F 21/88 361/679.56
2015/0060624 A1 * 3/2015 Huang ..... F16M 13/00 248/316.4
2015/0072555 A1 * 3/2015 Riddiford ..... F16M 11/041 439/575
2015/0129724 A1 * 5/2015 Kohmoto ..... F16M 13/00 248/52
2015/0196140 A1 * 7/2015 Lin ..... A47F 7/0246 248/551
2017/0188724 A1 * 7/2017 Lin ..... F16M 11/041
2019/0052740 A1 * 2/2019 Ormsbee ..... H04M 1/04
2021/0169239 A1 * 6/2021 Gulick, Jr. ..... F16M 11/041

OTHER PUBLICATIONS

European Patent Office, Extended Search Report, Application No. 19796333.3, Patent No. 3788221, Dated Jan. 1, 2022 (38 pages).

* cited by examiner

SECURITY APPARATUS

CROSS-REFERENCE TO RELATED APPLICATIONS

This application claims the benefit of and priority to U.S. Provisional Patent Application Ser. No. 62/655,911, filed Apr. 11, 2018 and entitled "TOOL-LESS DETACHABLE SECURITY APPARATUS," the entirety of which is incorporated herein by reference.

TECHNOLOGICAL FIELD

This invention relates to a detachable security apparatus that is easily locked and unlocked without the use of special tools, and which facilitates secure and functional display of portable, mobile, or handheld electronic devices.

BACKGROUND

Retailers sell a wide range of portable or hand held electronic device that can assist in or perform a multitude of tasks for the a user or customer. Part of the purchasing experience is having the ability to examine and test the device. This is done using floor models that are fitted with some form of security apparatus to prevent theft of the portable electronic device.

There are many different types of security apparatus used in retail settings. Some security apparatus allow a customer to pick up the electronic device while keeping it attached or tethered to the security apparatus. Other security apparatus comprise a fixed portion that remains coupled to the display surface and a second portion coupled to the electronic device. These security apparatus allow the customer to freely hold the electronic device while the second portion of the security apparatus remains attached to the electronic device. Unfortunately, these devices are not suitable for all types of electronic devices.

In all situations, an employee must use a tool or key to free the electronic device from the security apparatus. These keys are proprietary to the particular security apparatus and are frequently lost or stolen. Consequently, retailers must ordering extra keys every year. Other security apparatus use biometric sensors which permit a select group of employees to lock and unlock the security apparatus. While these devices eliminate the need for a separate key, they require frequent updates as a consequence of employee turnover.

These are just some of the problems associated with current security apparatus for handheld/portable electronic devices.

SUMMARY

A security apparatus is provided for retaining a electronic device when displayed to a customer for customer evaluation. The security apparatus comprises a housing including a base and a plurality of arms mounting to the base for holding the electronic device. The security apparatus also includes a locking mechanism moveable between a locked position and an unlocked position. The locking mechanism is configured to engage each of the plurality of arms to (i) secure the electronic device in the locked position, and (ii) release the electronic device in the unlocked position. The locking mechanism is accessible to a side of the housing which is inaccessible to the customer.

BRIEF DESCRIPTION OF DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following detailed description, read in connection with the drawings in which.

DETAILED DESCRIPTION

Figure 1:
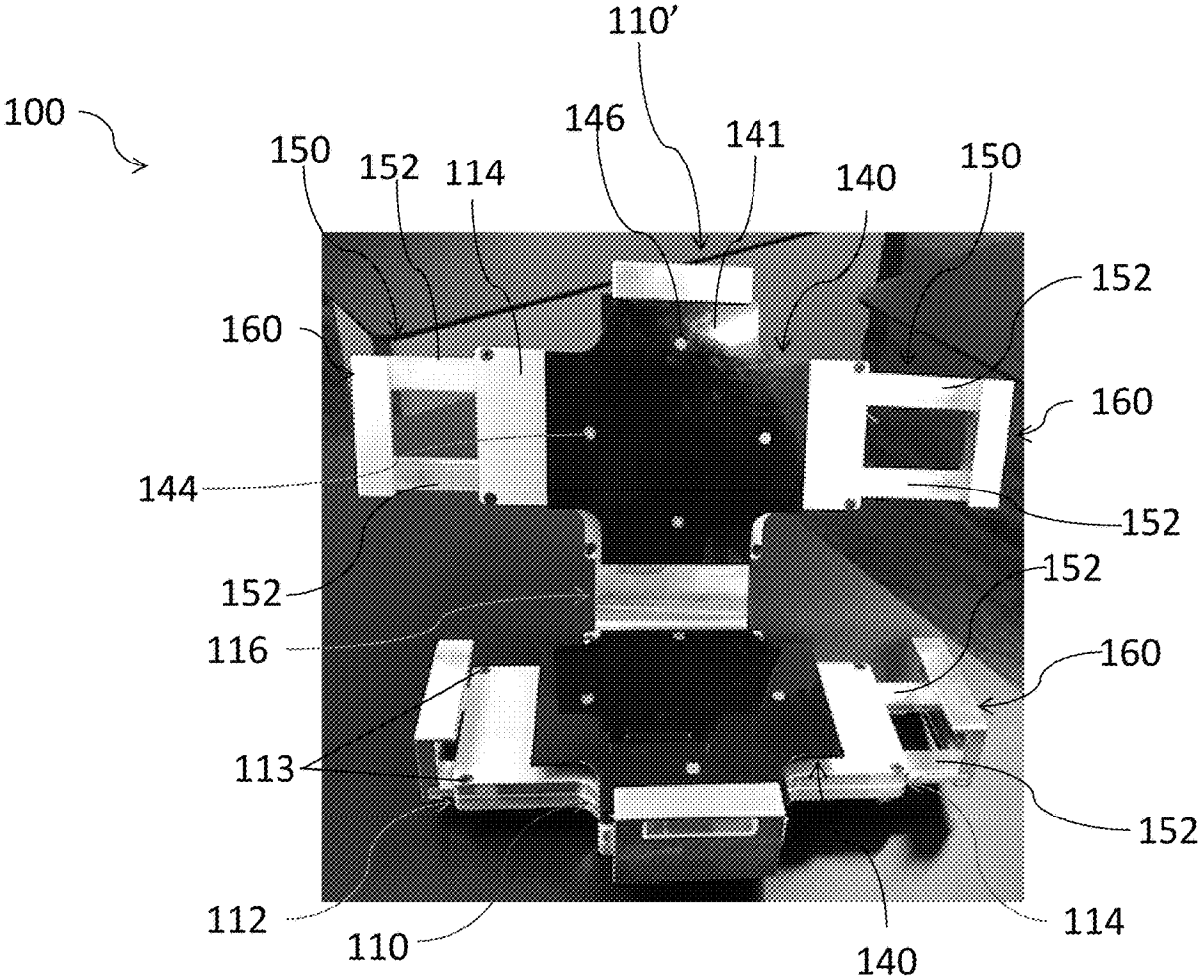
FIG. 1 illustrates a perspective front view of an embodiment of a tool-less detachable security apparatus.
Figure 2:
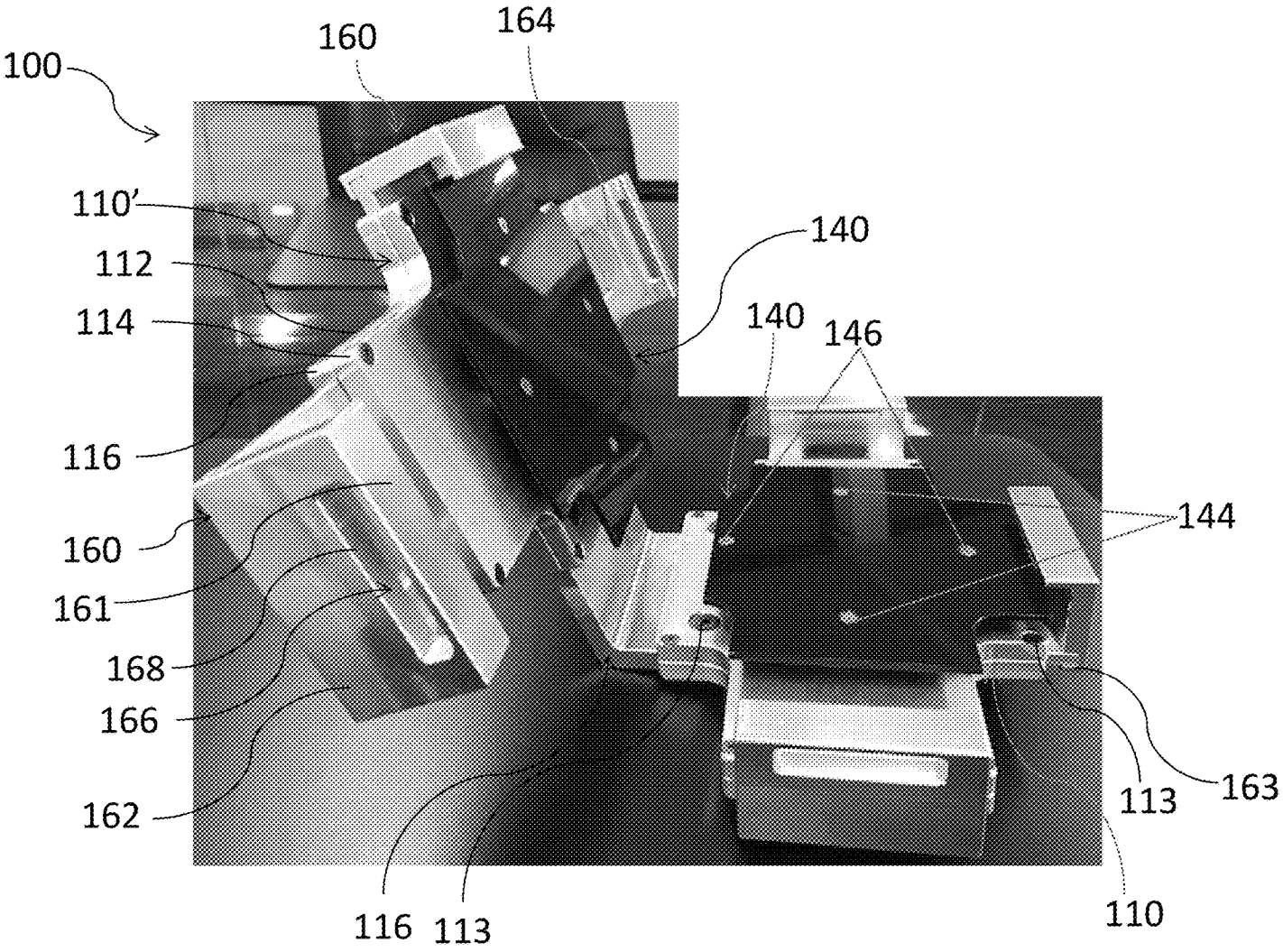
FIG. 2 illustrates a perspective side view of the tool-less detachable security apparatus depicted in FIG. 1.

FIGS. 1-2 illustrate an embodiment of a tool-less detachable security apparatus ("security apparatus") 100. The security apparatus 100 generally comprises a body or housing 110 and a plurality of moveable extensions or arms 150. As shown, the housing 110 comprises a base 112 and a cap 114 that is configured to couple to the cap facing surface 118 (FIGS. 5-9) of the base 112 using a plurality of fasteners 113, such as screws, bolts or any other suitable fastener. The housing may be comprised of one or more types of metal, such as steel or aluminum, or one or more types of plastic, such as PA6 (Nylon 6) or ABS (Acrylonitrile butadiene styrene). In one embodiment, the base 112 may be comprised of a combination of metallic and plastic components.

Referring to FIG. 1, the housing 110 and base 112 attaches to a retail display counter using one or more fasteners 113, such as wing nut fasteners. In this manner, the security apparatus 100 may be securely locked down onto the retail display counter. As will be seen in the subsequent discussion, the housing 110 includes a security device or mechanism which allows for the retention and release of an electronic device. Inasmuch as the security mechanism is not accessible to a customer evaluating the device, the security mechanism may include a rather simple, inexpensive latching mechanism for holding and securing the electronic device. More specifically, the housing is mounted to the display apparatus such that the retention/release mechanism of the security device is inaccessible to the customer evaluating the electronic device, e.g., for purchase, however, once the same retention/release mechanism is accessible, the electronic device may be released and replaced with another, i.e., new model, by a simply rotating a disk or a push of a button. It will be appreciated that a newer model may have slightly larger or different external dimensions such that slightly different dimensions may be required for securely holding an expensive electronic device.

In the embodiments illustrated in FIGS. 1-4, the housing 110 comprises a first housing portion 110 and a second housing portion 110' that are coupled to each other at a transition portion 116. The transition portion 116 is configured to couple the two bodies 110, 110' while allowing each body 110 to extend along a different plane. As shown in the embodiments depicted in FIGS. 1-4, the first housing portion 110 and the second housing portion 110' are identical and comprise identical components. As such, the components of the security apparatus 100 will be described and identified without reference to whether they are positioned on the first housing portion 110 or the second housing portion 110'. In other embodiments, the first housing portion 110 and the second housing portion 110' may not be comprised of identical components, and in yet other embodiments only one (1) housing portion may be required such that a transition portion 116 may not be present.

Figure 3:
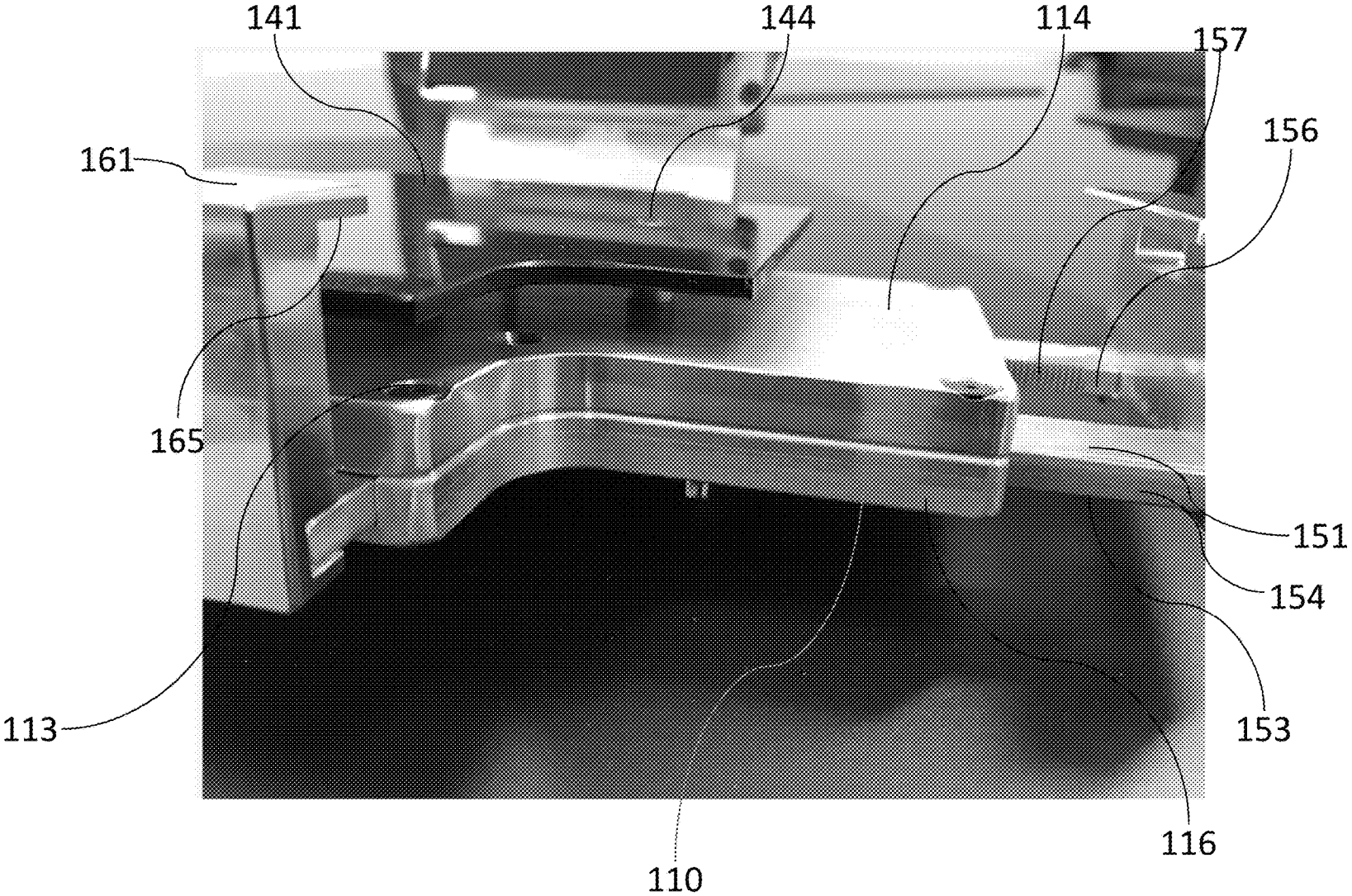
FIG. 3 illustrates an enlarged side view of an embodiment of the tool-less detachable security apparatus depicted in FIG. 1.
Figure 4:
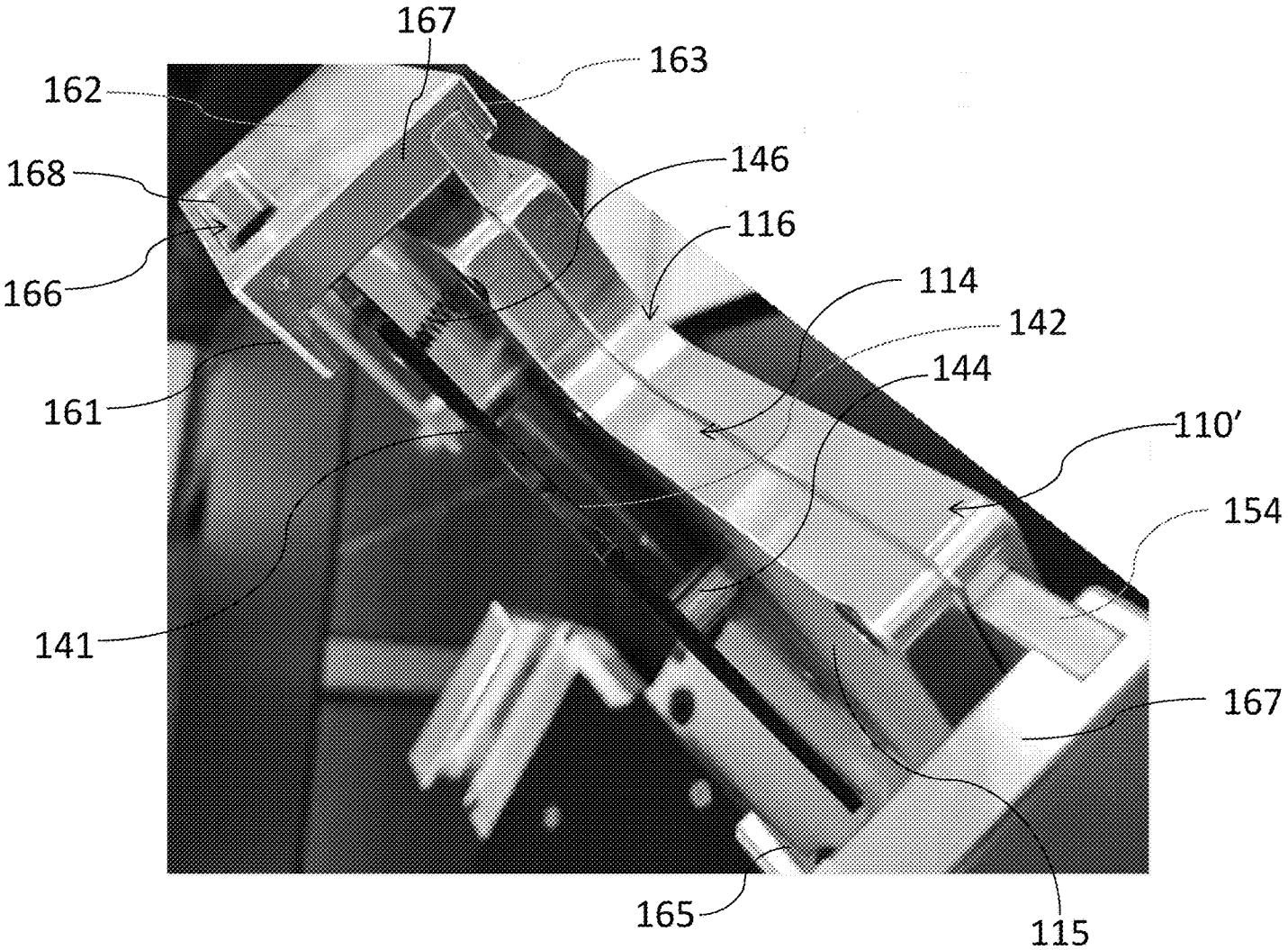
FIG. 4 illustrates an enlarged side view of the tool-less detachable security apparatus.

As shown in FIGS. 1-4, the body 110 further comprises a thickness compensation or leveling plate 140 (hereinafter "compensation plate") having a top surface 141 and a bottom surface 142. The compensation plate 140 is coupled to a top surface 115 of the cap 114 by one or more adjustment members configured to allow movement of the compensation plate 140 to increase or decrease the space between the bottom surface 142 of the compensation plate 140 and the top surface 115 of the cap 114. As shown in FIGS. 3 and 4, the adjustment members are one or more push rods 144 and one or more springs 146, however other types of adjustment members may be used in other arrangements. For example, in another embodiment, the housing or body 110 may include a pad or other resilient surface rather than the compensation plate 140 which accommodates portable electronic devices of varied thicknesses.

Figure 5:
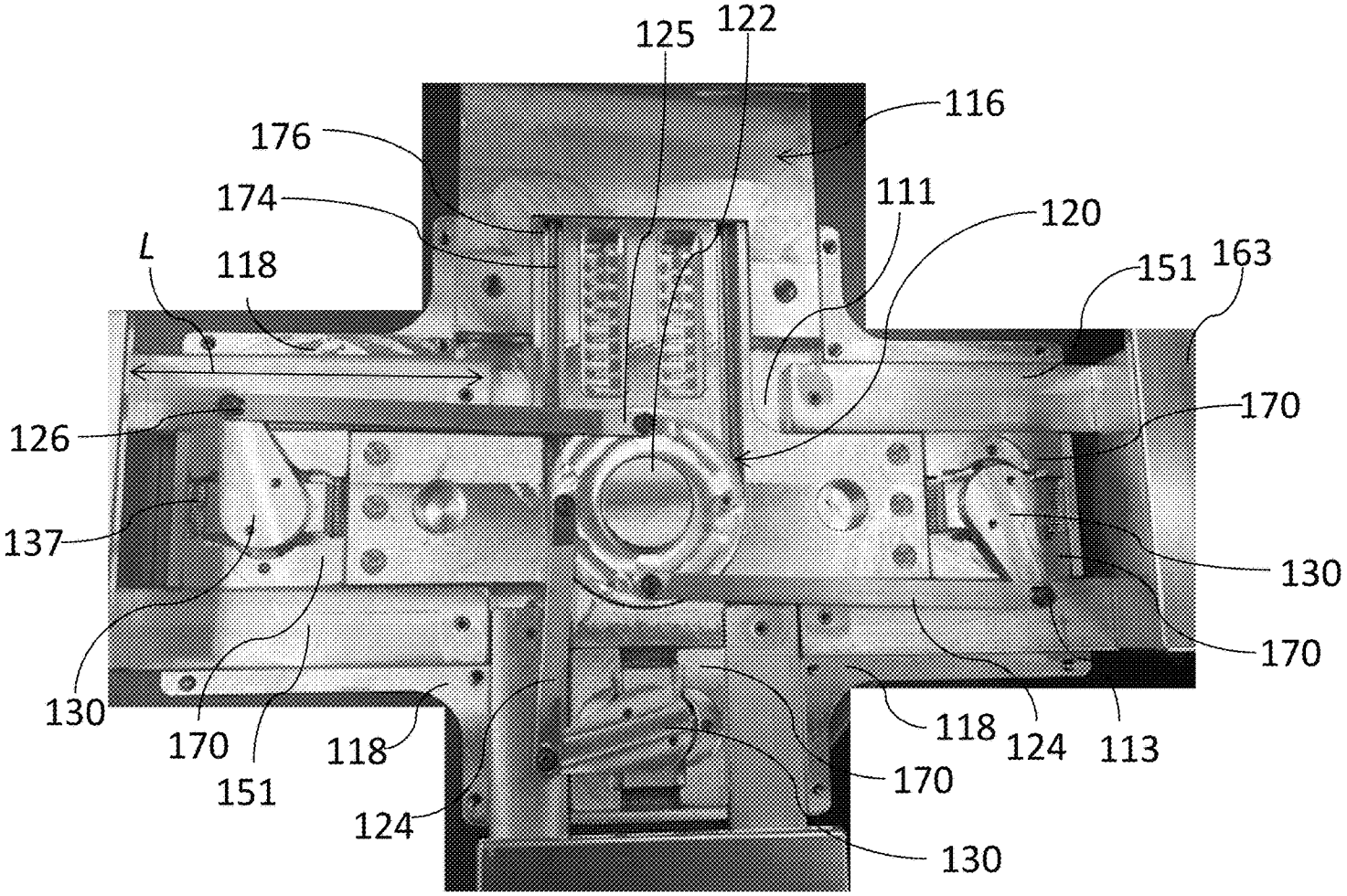
FIG. 5 illustrates a broken away top view of the tool-less detachable security apparatus revealing the internal details of the base.
Figure 11:
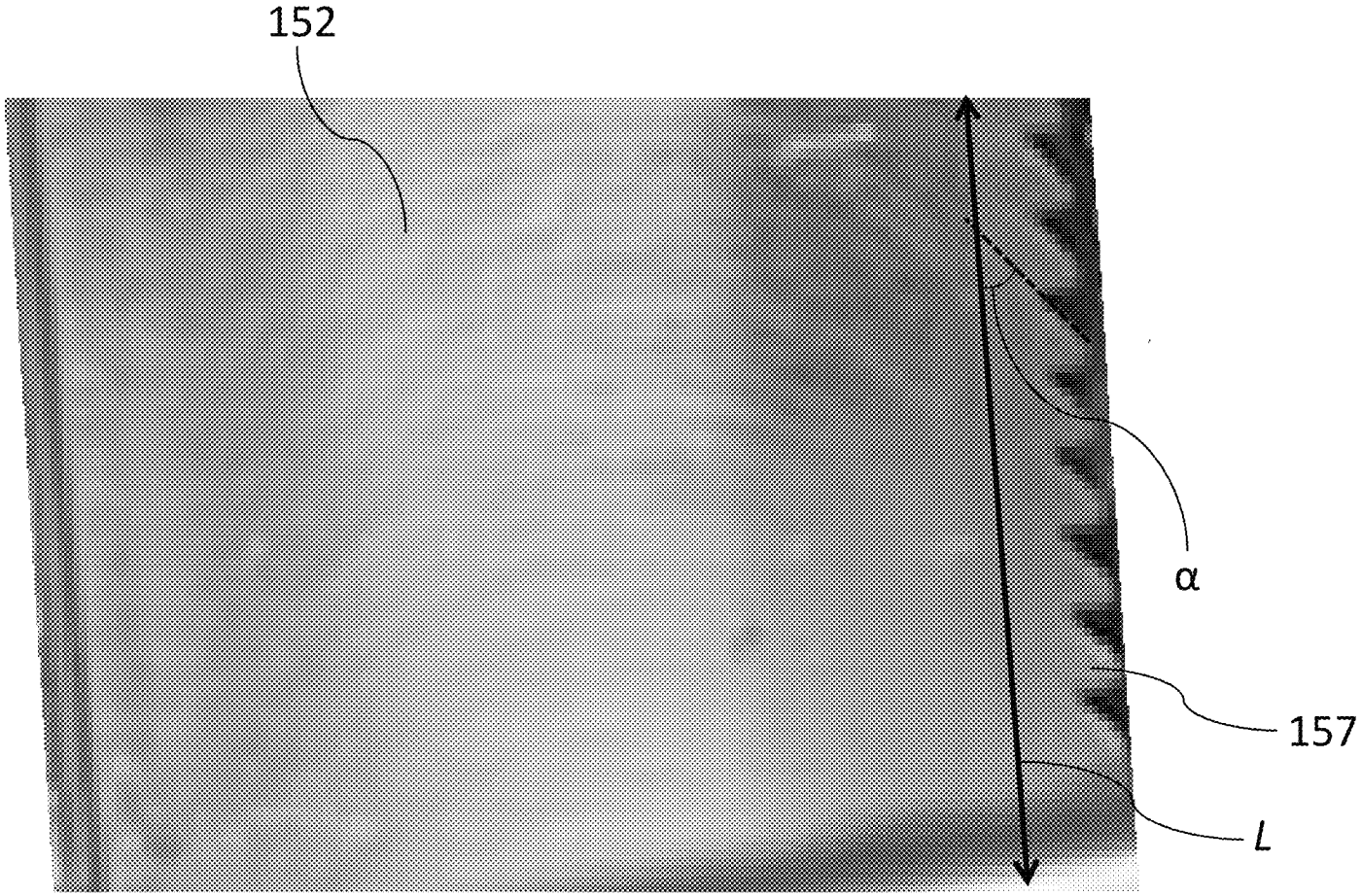
FIG. 11 illustrates an enlarged of an arm support of the tool-less detachable security apparatus.

In FIGS. 1-5, the security apparatus 100 comprises a plurality of arms 150 that are configured to adjust in order to accommodate portable electronic devices of different sizes as well as to secure the devices to the security apparatus 100. As shown in FIG. 5, each arm 150 comprises one or more arm supports 152 and a holder 160. In the embodiments shown, each arm 150 comprises two arm supports 152 extending along an axis L. Each arm support 152 comprises a top surface 151, a bottom surface 153, an outer facing surface 154, and an inner surface 156. As shown, the inner surface 156 of each arm support 152 may include a plurality surface features configured to allow for adjustment and locking of the arm support 152. In the illustrated embodiment, the inner surface 156 may include a plurality of teeth 157 (best seen in FIG. 11) positioned at an angle $\alpha$ relative to the axis L of the arm support 152.

Figure 6:
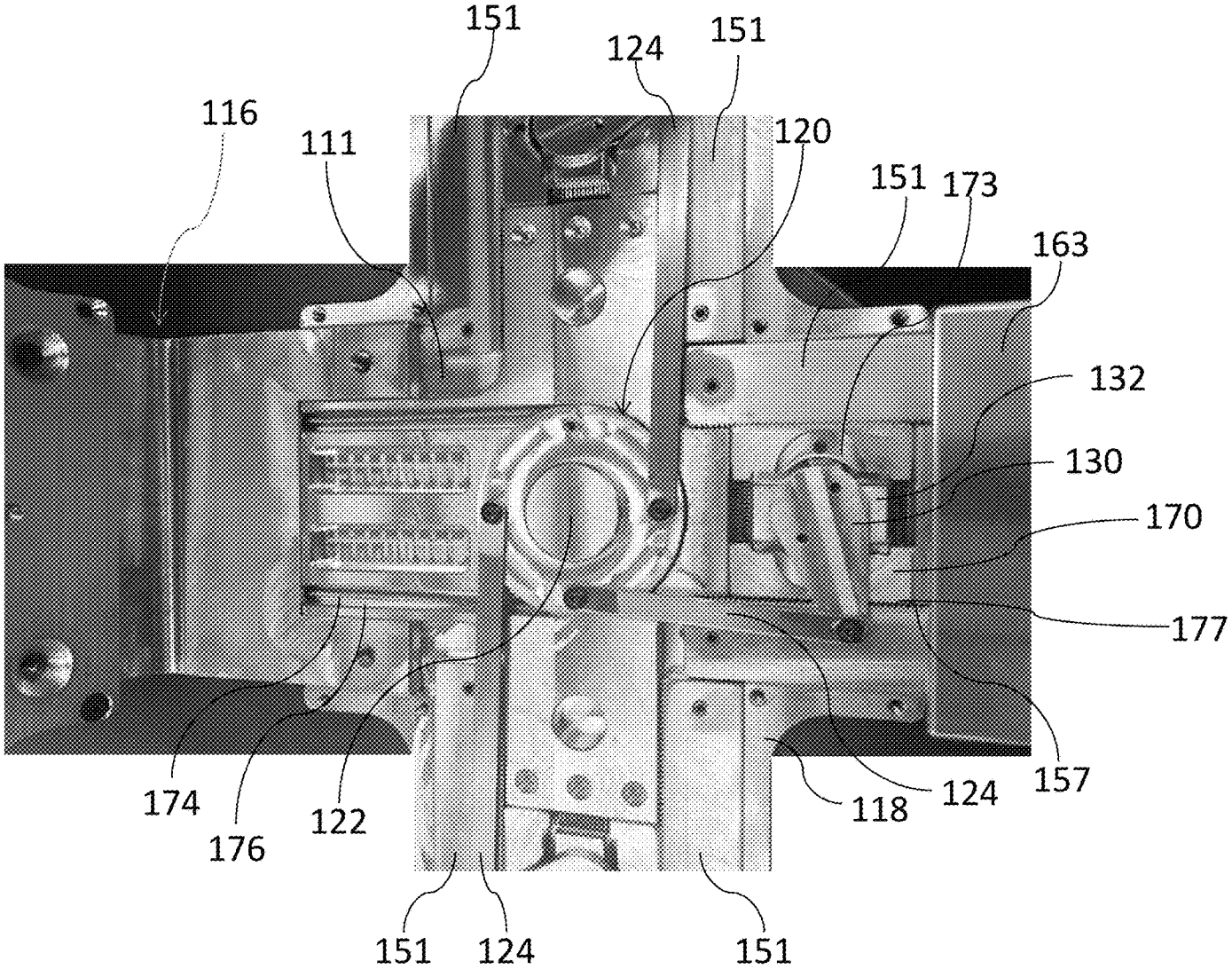
FIG. 6 illustrates a perspective top view of the base of the tool-less detachable security apparatus.
Figure 7:
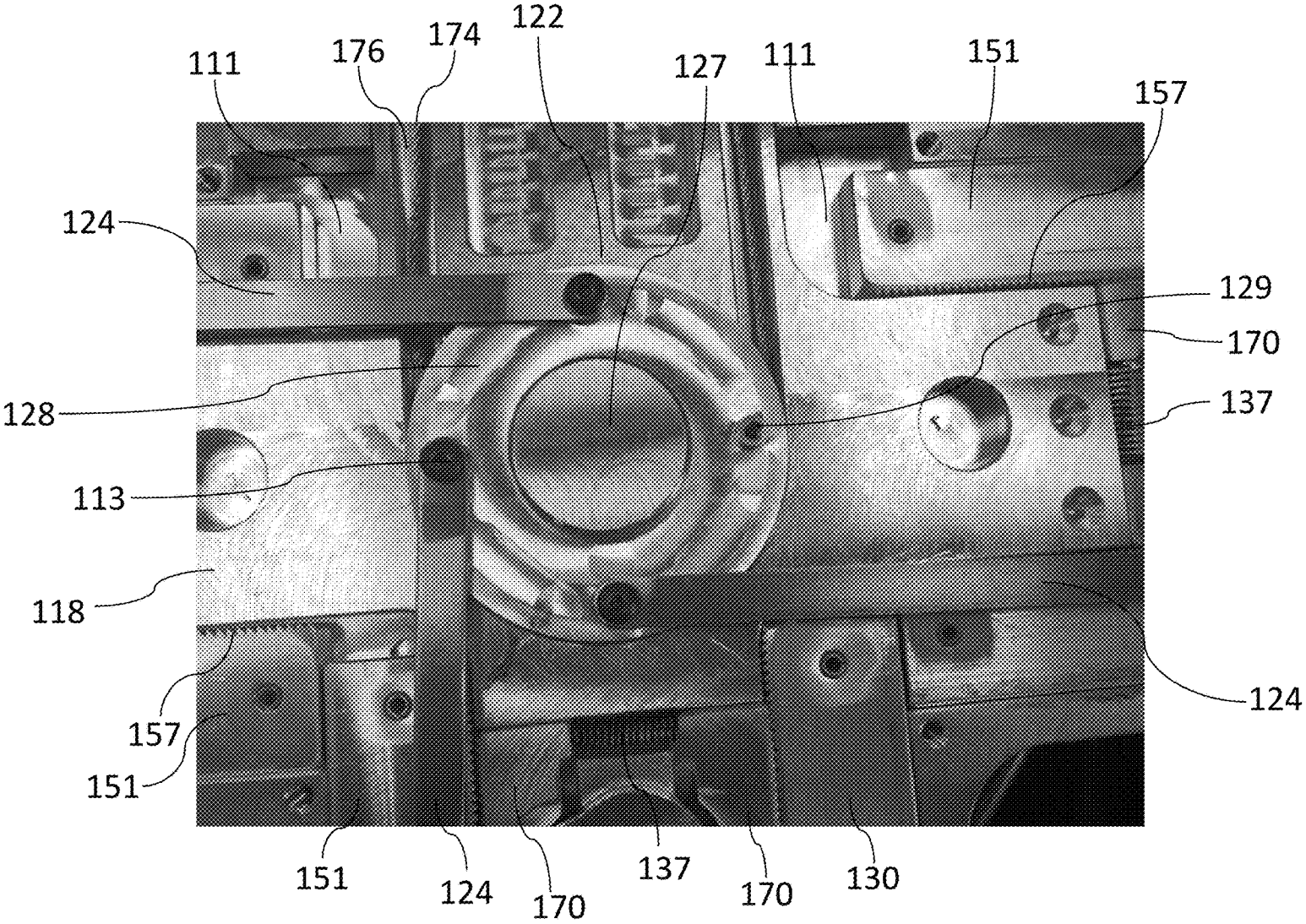
FIG. 7 illustrates an enlarged view of a linking disk of the tool-less detachable security apparatus.
Figure 8:
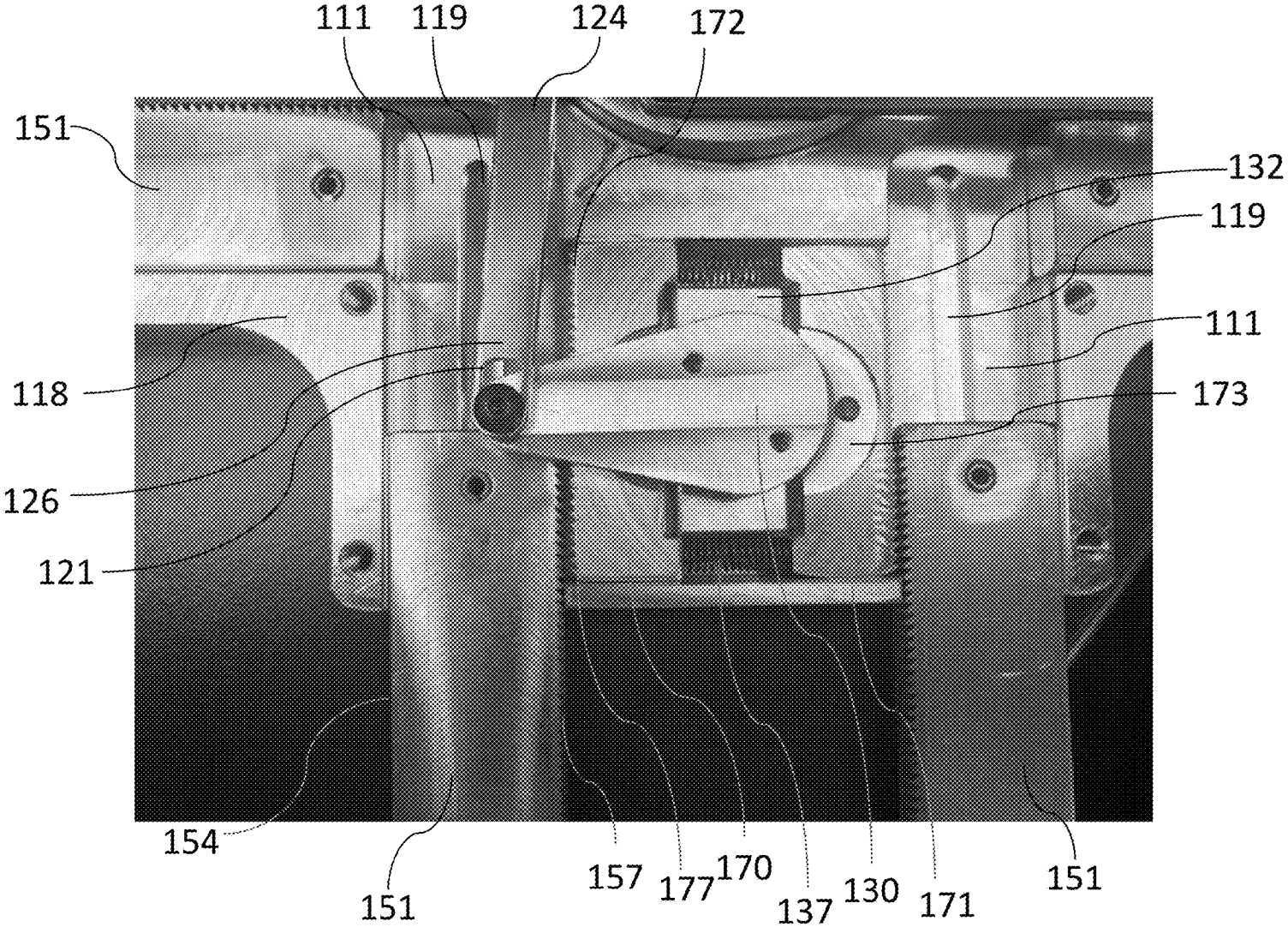
FIG. 8 illustrates an enlarged view of an engager crank of the tool-less detachable security apparatus.
Figure 9:
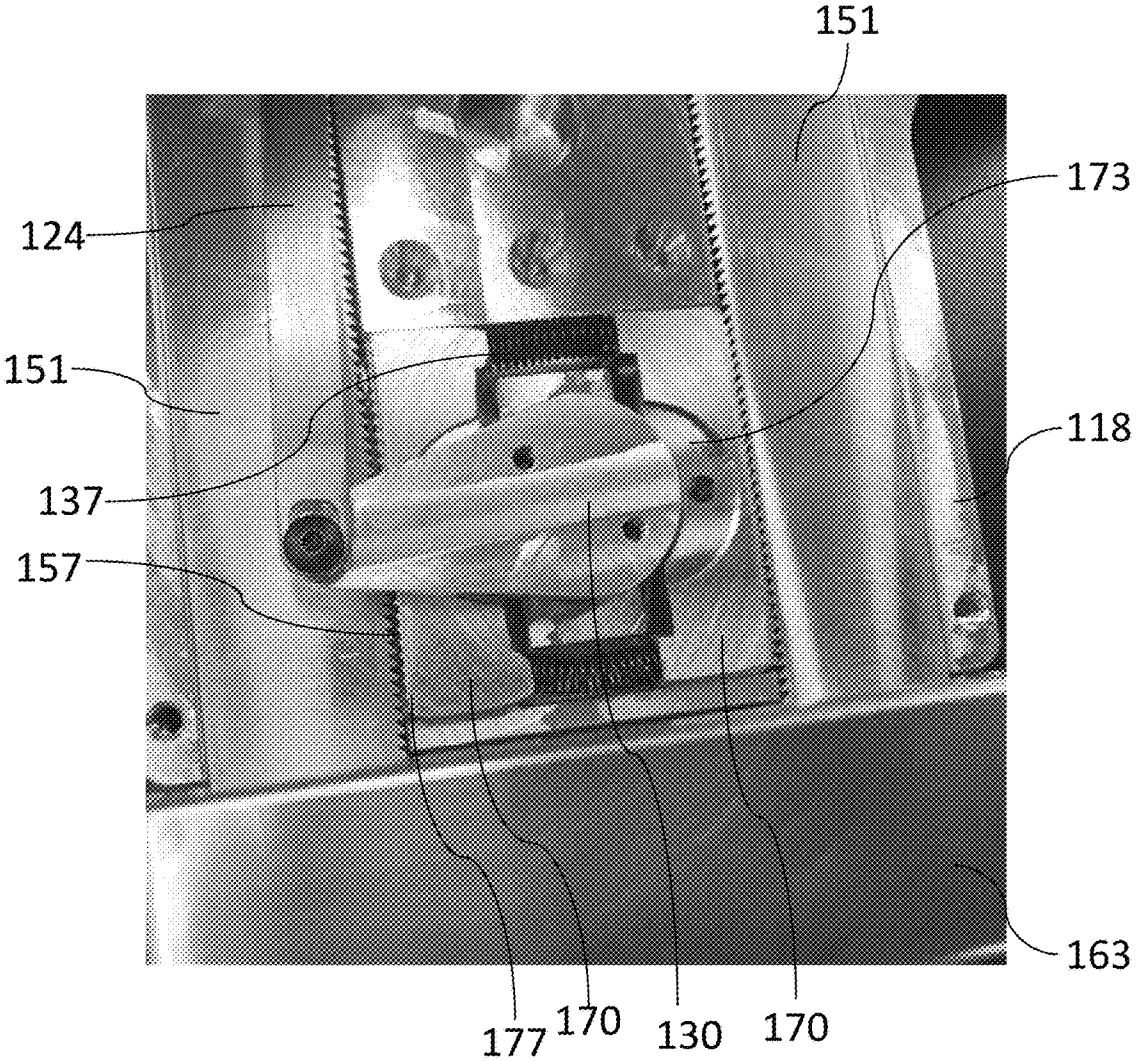
FIG. 9 illustrates an enlarged view of an extension engager of the tool-less detachable security apparatus.

As shown in FIGS. 5-8, the bottom surface 153 of the arm 150 is configured to be positioned into and move through a cavity or channel 111 formed in the base 112 of the housing 110. Referring to FIG. 8, the arm 150 is shown in an extended position such that the arm channel 111 and an arm sub channel 119 are clearly visible. As shown, the bottom surface 153 of the arm 150 may be configured to couple to the base 112 via the arm sub channel 119. The arm sub channel 119 may be further configured to guide the arm 150 as it is extended and retracted from the base 112 and to prevent over retraction/over extension of the arm 150. In an embodiment, the arm channel 111 does not have an arm sub channel 119 and the arm support 152 may instead couple to a portion of the arm channel 111. The arm channel 111 and/or the arm support 152 may comprise stop members configured to prevent over retraction/over extension of the arm support 152. That is, the stop members may be configured to prevent the arm supports 152 from being inadvertently removed from of the arm channel 111.

One end of the arm support 152 is coupled to a holder 160 by a welded joint, rivets, metal pins, or any other type of permanent connection. The holder 160 comprises a top surface 161, a bottom surface 163, a front surface 162, a back surface 164, and two or more side surfaces 167. The two or more side surfaces 167 are substantially parallel to each other, however in other embodiments, the two or more side surfaces 167 may not be substantially parallel to each other. As shown, the top surface 161 and the bottom surface 163 are substantially parallel to each other, however in other embodiments they may not be substantially parallel to each other. As shown, the front and back surfaces 162, 164 define an opening 166 extending between the front and back surfaces 162, 164, and having an interior surface 168. The top surface 161 extends from the front surface 162 to a point beyond the back surface 164 to create a lip 165 (FIG. 4). In an embodiment, the arm supports 152 and the holder 160 may be comprised of the same material, however in other embodiments, they may be comprised of different materials. In one embodiment, the arm supports 152 are comprised of steel and the holder is comprised of zinc.

Figure 10:
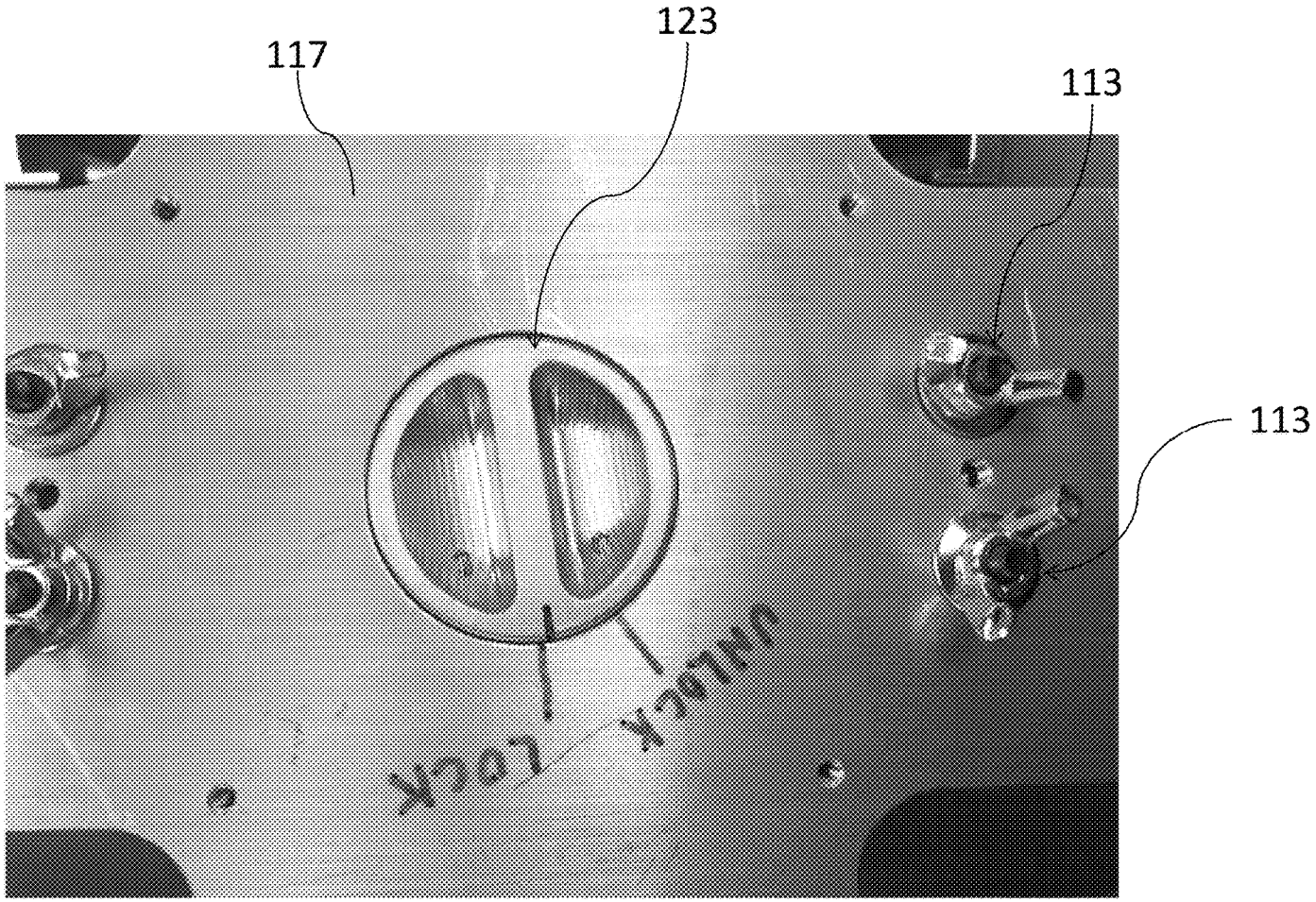
FIG. 10 illustrates a bottom view of the tool-less detachable security apparatus.

FIGS. 5-9 depict embodiments of the housing 110 of the security apparatus 100 with at least a portion of the cap 114 removed. As shown, the base 112 further comprises a cap facing surface 118 that is configured to face or contact the cap 114 when the housing 110 is assembled. The base 112 further comprises one or more cavities or channels configured to house or partially house elements of a locking/displacement mechanism or a security assembly 120 (hereinafter referred to as a locking mechanism). The locking mechanism 120 comprises a linking disk 122 that is coupled to a lock 123 positioned on the bottom surface 117 of the housing 110 (FIG. 10) such that actuation of the lock 123 results in actuation of the linking disk 122. As shown, the lock 123 (FIG. 10) is a dial, however in other embodiments, the lock 123 may comprise a switch, push button, knob, lever, or the like. The linking disk 122 comprises a center portion 127 and a rim portion 128. The rim portion 128 may comprise a plurality of coupling members configured to couple a wheel coupling end 125 of a link 124 or a plurality of holes 129, each configured to accept a fastener 113 to couple the wheel coupling end 125 of the link 124 to the rim portion 128.

The link 124 extends along an axis from the wheel coupling end 125 to an opposing, crank coupling end 126, which is configured to couple to a portion of an engager crank 130. As shown in the embodiments depicted in FIGS. 8 and 9, the crank coupling end 126 of the link 124 defines an opening 121 that is configured to accept a fastener 113 to fasten it to a portion of the engager crank 130. The opening 121 is dimensioned to have a greater diameter along the axis of the link 124. The engager crank 130 is pivotally coupled to a housing 132 that is coupled to the base 112. The link 124 couples the engager crank 130 to the linking disk 122.

At least one engager support or shoe 170 is positioned adjacent to the housing 132 and comprises a side 172 with complimentary engagement features 177 configured to engage the engagement features 157 of the arm support 152. As shown in the embodiments depicted in FIGS. 5-9, the complimentary engagement features 177 are a complimentary set of teeth 177. The at least one shoe 170 may have a top surface 171 that has a depression, cut-out, or other surface feature 173 configured to accept a portion of the engager crank 130. The shoe 170 may be coupled to or in contact with a retractable member that is housed inside the housing 132 when the security apparatus 100 is on the "unlocked" position. The retractable member is configured to emerge from the housing in response to a pivoting of the engager crank 130 when the security apparatus 100 lock 123 is moved from the "unlocked" to the "locked" position. As shown especially in FIGS. 8-9, one or more springs 137 or other resilient members may assist in the movement of the one or more support engagers 170. As shown in FIGS. 5-9, one or more components of the locking mechanism 120 may be comprised of plastic, such as POM (Polyoxymethylene).

When the lock 123 (FIG. 10) is turned to the "locked" position (FIG. 10), the linking disk 122 rotates in a clockwise direction, which exerts a force on the link 124 that is imparted to the engager crank 130 to cause it to pivot or rotate in a clockwise direction as well. The pivoting or rotating of the engager crank 130 drives the shoe 170 into engagement with the inner facing surface 156 of the arm support 152 such that the arm support teeth 157 engage with the support engager teeth 177. The angled nature of the teeth 157, 177 allows the arm support 152 to move past the shoe 170 such that the arm 150 may be freely retracted into the base 112. However, at the same time the angled nature of the teeth 157, 177 prevents the arm support 152 and the shoe 170 from moving past each other in the opposite direction so that the arm 150 cannot be extended from the base 112. When the lock 123 is turned to the "unlocked" position (FIG. 10), the linking disk 122 moves in a counterclockwise direction, which exerts a force on the link 124 that is imparted to the engager crank 130 to cause it to pivot or rotate in a counterclockwise direction as well. The pivoting or rotating of the engager crank 130 drives the shoe 170 away from the inner facing surface 156 of the arm support 152 such that the arm support teeth 157 are spaced apart from the support engager teeth 177. In the "unlocked" state, the arms 150 of the security apparatus 100 may be freely extended and retracted.

In the embodiments depicted in FIGS. 1-4, the security apparatus 100 may comprise two bodies 110, 110' (FIGS. 1-4) that are coupled together by the transition portion 116. Referring to FIGS. 5-7, the linking disk 122 is coupled to one or more cables 174. As shown, the one or more cables 174 are positioned in cable channels 176 that run from the linking disk 122 through the transition portion 116 to another linking disk (not shown) disposed in the second body 110'. This allows movement of the linking disk 122 of the first body 110 to translate into an identical movement of the linking disk of the second body 110' and hence an identical locking or unlocking of the arms 150 of the second body 110'.

In a further embodiment that is not shown in the figures, the body 110 may be coupled to a pedestal or the body 110 and the pedestal may be formed as a single unit. As such, the pedestal may be coupled to the retail display counter in a similar manner was previously discussed with regard to the body 110. The pedestal may be hollow and comprise a bottom surface having a lock that is configured to be actuated in order to "lock" and "unlock" the security apparatus. One or more coupling members may be coupled to the lock at one end and extend through the hollow pedestal to couple to a linking disk at an opposite end such that actuation of the lock caused movement of the linking disk. The movement of the linking disk in turn causes the corresponding locking and unlocking of the arms. In an embodiment, the coupling members are rigid structures.

In order to load the security apparatus 100 with a portable electronic device, the lock 123 is moved to the "unlocked" position and the arms 150 are extended from the body 110. The portable electronic device is then placed on the compensation plates 140 and the arms 150 are pushed towards the body 110 so that a portion of the electronic device is positioned under the lip 165 of the holder 160. As was previously described, the compensation plate(s) 140 is configured to be moved along an axis that is substantially perpendicular to the top surface 115 of the cap 114. Accordingly, the compensation plate(s) may be depressed to accommodate portable electronic devices of varying thicknesses. Once the arms 150 are retracted to secure the portable electronic device, the lock 123 is moved to the "locked" position and the arms 150 cannot be extended from the body 110. Alternatively, the lock 123 may be moved to the "locked" position after the arms 150 are extended from the body 110. In this manner, the arms 150 may be pushed towards the body 110 to secure the portable electronic device, but they cannot be extended from the body 110. The security apparatus 100 is then secured to the retail display counter using the one or more fasteners (FIG. 10) such that the lock 123 is no longer accessible.

In order to remove the portable electronic device, the security apparatus 100 must first be detached from the retail display counter. Next, the lock 123 is moved to the "unlocked" position and the arms 150 are extended from the base 112 to release the portable electronic device. Another portable electronic device may then be loaded into the security apparatus 100, locked in place and the security apparatus 100 may once again be secured to the retail display counter.

While the present invention has been particularly shown and described with reference to certain exemplary embodiments, it will be understood by one skilled in the art that various changes in detail may be effected therein without departing from the spirit and scope of the invention that can be supported by the written description and drawings. Further, where exemplary embodiments are described with reference to a certain number of elements, it will be understood that the exemplary embodiments can be practiced utilizing either less than or more than the certain number of elements.

The invention claimed is:

1. A security apparatus for retaining an electronic device during evaluation by a customer, the security apparatus comprising:

a housing including a base, the base comprising at least one shoe;

a plurality of arms mounting to the base and configured to hold the electronic device, wherein the at least one shoe is configured for lateral displacement toward and away from at least one of the plurality of arms; and a locking mechanism moveable between a locked position and an unlocked position, the locking mechanism comprising, a disc-shaped member rotationally mounted to the base about a first axis, and a crank member rotationally mounted to the base about a second axis parallel to the first axis and configured to move the at least one shoe into and out of engagement with each of the plurality of arms to (i) secure the electronic device in the locked position, and (ii) release the electronic device in the unlocked position, wherein the locking mechanism is accessible to a side of the housing which is inaccessible to the customer.

2. The security apparatus of claim 1,
wherein at least one of the plurality of arms includes a surface feature;
wherein the base includes a complementary surface feature;
wherein the locking mechanism causes the surface feature of the at least one of the plurality of arms to engage the complementary surface feature of the base in the locked position; and
wherein the locking mechanism causes the surface feature of the at least one of the plurality of arms to disengage the complementary surface feature of the base in the unlocked position.

3. The security apparatus of claim 1,
wherein the base includes at least one elongate channel; and
each arm includes at least one elongate support slideably engaging the at least one elongate channel and a holder mounting to an end of the arm.

4. The security apparatus of claim 2, further comprising
a linking member connecting the disc-shaped member to the crank member such that rotation of the disc-shaped member effects rotation of the crank member to move the locking mechanism between the locked position and the unlocked position,
wherein the at least one shoe defines the surface feature.

5. The security apparatus of claim 4,
wherein the shoe is spring-biased in a direction away from the surface feature of the at least one of the plurality of arms in the unlocked position; and
wherein the crank member urges the at least one shoe toward the surface feature of the arm in the locked position.

6. The security apparatus of claim 4,
wherein the housing includes a plurality of holders, each holder engaging an edge of the electronic device;
wherein the base includes a plurality of shoes corresponding to a number of holders; and
wherein the locking mechanism further comprises:
a plurality of crank members each connecting at one end to a peripheral portion of the disc-shaped member; and
wherein movement of the locking mechanism enables a plurality of shoes to engage and disengage the surface feature of the plurality of holders to lock/unlock the electronic device.

7. The security apparatus of claim 6 further comprising:
a cap coupled to the base for enclosing the locking mechanism.

8. The security apparatus of claim 7 further comprising:
a compensation plate coupled to the base and disposed over the cap to urge the electronic device against a lip of each holder.

9. The security apparatus of claim 8,
wherein the compensation plate is spring-biased toward the lip to compensate for thickness variations between the lip of the holder and the compensation plate.

10. The security apparatus of claim 8,
wherein the compensation plate include a resilient pad to compensate for thickness variations between the lip of the holder and the compensation plate.

11. A security apparatus for retaining an electronic device on display for customer evaluation, the security apparatus comprising:
a housing including at least one shoe;
a plurality of moveable holders configured to hold the electronic device, the holders slidably mounting to the housing, wherein the at least one shoe is configured to be displaced laterally to contact at least one of the plurality of moveable holders; and
a displacement mechanism moveable between a locked position and an unlocked position, the displacement mechanism comprising,
a disc-shaped member rotationally mounted to the housing about a first axis, and
a crank member rotationally mounted to the housing about a second axis parallel to the first axis and configured to engage each of the plurality of moveable holders to (i) secure the electronic device in the locked position, and (ii) release the electronic device in the unlocked position,
wherein the displacement mechanism is accessible to a side of the housing which is inaccessible to the customer.

12. The security apparatus of claim 11,
wherein the housing includes a surface feature;
wherein at least one of the holders includes a complementary surface feature; and
wherein the displacement mechanism causes the surface feature of the at least one holder to engage the complementary surface feature of the housing in the locked position; and
wherein the displacement mechanism causes the surface feature of the at least one holder to disengage the complementary surface feature of the housing in the unlocked position.

13. The security apparatus of claim 12,
wherein the holder includes an elongate arm support;
wherein the housing includes a base having at least one elongate channel; and
wherein the elongate arm support slideably engages the at least one elongate channel.

14. The security apparatus of claim 13, further comprising
a linking member connecting the disc-shaped member to the crank member such that rotation of the disc-shaped member effects rotation of the crank member to move the locking mechanism between the locked position and the unlocked position,
wherein the at least one shoe defines a surface feature.

15. The security apparatus of claim 14,
wherein, the shoe is spring-biased in a direction away from a surface feature of the holder in the unlocked position; and
wherein the crank member urges the at least one shoe toward the surface feature of the holders in the locked position.

16. The security apparatus of claim 14,
wherein the housing includes a plurality of holders, each holder engaging an edge of the electronic device,
wherein the base includes a plurality of shoes corresponding to a number of holders; and
wherein a displacement mechanism further comprises:
a plurality of crank members each connecting at one end to a peripheral portion of the disc-shaped member; and
wherein movement of the displacement mechanism enables a plurality of shoes to engage and disengage a surface feature of the plurality of holders to lock/unlock the electronic device.

17. The security apparatus of claim 16 further comprising:
a cap coupled to the housing for enclosing the displacement mechanism.

18. The security apparatus of claim 17 further comprising:
a compensation plate coupled to the housing and disposed over the cap to urge the electronic device against a lip of each of the plurality of holders.

19. The security apparatus of claim 18, wherein the compensation plate is spring-biased toward the lip to compensate for thickness variations between the lip of the holder and the compensation plate.

20. A security apparatus comprising:

a plurality of arms comprising at least one support member and a holder, the at least one support member comprising one or more surface features on one side;

a housing comprising a base and a cap, wherein the base includes a security assembly comprising:

a linking disk coupled to an end of each of a plurality of link members;

a plurality of cranks, each coupled to an opposite end of each of the plurality of link members; and a plurality of support engagers, each positioned proximate one of the plurality of cranks and comprising one or more complementary surface features on one side;

a compensation plate coupled to the housing with one or more resilient members; and a lock coupled to the linking disk and configured to move between a locked position and an unlocked position, wherein movement of the lock into the locked position causes the linking disk to rotate, which in turn causes the plurality of cranks to rotate;

wherein the rotation of each crank causes each of the plurality of support engagers to move into contact with the at least one support member such that the one or more surface features of the at least one support member are engaged with the one or more complementary surface features of the support engager.

* * * * *